US006327953B1

(12) United States Patent
Andresen

(10) Patent No.: US 6,327,953 B1
(45) **Date of Patent: *Dec. 11, 2001**

(54) DEVICE FOR STORING PROJECTILE BALLS AND FOR FEEDING THEM TO THE PROJECTILE CHAMBER OF A HAND WEAPON

(75) Inventor: Heddies Andresen, Quickborn (DE)

(73) Assignee: Armatec GmbH & CIE. KG, Hamburg (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/327,818

(22) Filed: Jun. 8, 1999

(30) Foreign Application Priority Data

May 17, 1999 (DE) ..... 199 22 589

(51) Int. Cl.[7] ..... F41A 9/02

(52) U.S. Cl. ..... 89/33.17; 89/33.02; 89/34; 42/50; 124/45; 124/48; 124/52

(58) Field of Search ..... 89/34, 33.02, 33.17; 42/50, 1.02; 124/72, 82, 45, 48, 52, 53

(56) References Cited

U.S. PATENT DOCUMENTS

| | | | | |
|---|---|---|---|---|
| 1,403,719 | | 1/1922 | Szepe . | |
| 1,404,689 | | 1/1922 | Fairweather . | |
| 1,743,576 | | 1/1930 | Smith . | |
| 1,867,513 | * | 7/1932 | Lahti | 42/1.02 |
| 2,357,951 | * | 9/1944 | Hale | 124/72 |
| 2,398,263 | * | 4/1946 | Trimbach | 89/34 |
| 3,248,008 | | 4/1966 | Meierjohan | 221/205 |
| 3,467,073 | * | 9/1969 | Rhodes | 124/75 |
| 3,610,223 | | 10/1971 | Green | 124/16 |
| 3,695,246 | | 10/1972 | Filippi et al. | 124/11 |
| 3,788,298 | | 1/1974 | Hale | 124/11 R |
| 3,844,267 | | 10/1974 | Mohr | 124/1 |
| 3,867,921 | | 2/1975 | Politzer | 124/26 |
| 4,207,857 | | 6/1980 | Balka, Jr. | 124/56 |
| 4,332,097 | * | 6/1982 | Taylor, Jr. | 42/50 |
| 4,926,742 | * | 5/1990 | Ma et al. | 89/33.02 |
| 4,951,548 | * | 8/1990 | Wixon et al. | 89/34 |
| 4,965,951 | * | 10/1990 | Miller et al. | 89/33.02 |
| 5,063,905 | | 11/1991 | Farrell | 124/72 |
| 5,097,816 | | 3/1992 | Miller | 124/49 |
| 5,282,454 | | 2/1994 | Bell et al. | 124/49 |
| 5,490,493 | * | 2/1996 | Salansky | 124/78 |
| 5,505,188 | | 4/1996 | Williams | 124/74 |
| 5,511,333 | | 4/1996 | Farrell | 42/49.01 |
| 5,520,171 | * | 5/1996 | David | 124/51.1 |
| 5,722,383 | * | 3/1998 | Tippmann, Sr. et al. | 124/76 |
| 5,736,720 | | 4/1998 | Bell et al. | 235/1 B |
| 5,771,875 | | 6/1998 | Sullivan | 124/72 |
| 5,794,606 | | 8/1998 | Deak | 124/51.1 |
| 5,816,232 | | 10/1998 | Bell | 124/51.1 |
| 5,839,422 | | 11/1998 | Ferris | 124/53.5 |
| 5,881,962 | * | 3/1999 | Schmidt et al. | 242/374 |
| 5,954,042 | * | 9/1999 | Harvey | 124/51.1 |

FOREIGN PATENT DOCUMENTS

| | | |
|---|---|---|
| 3721527 C2 | 5/1989 | (DE) . |
| 43 43 870 A1 | 6/1994 | (DE) . |
| WO 98/13660 | 4/1998 | (WO) . |

OTHER PUBLICATIONS

English abstract of German reference DE 43 43 870 A1.

* cited by examiner

*Primary Examiner*—Stephen M. Johnson
(74) *Attorney, Agent, or Firm*—Alix, Yale & Ristas, LLP

(57) ABSTRACT

A device for storing projectile balls and for feeding them to the projectile chamber of a hand weapon (1), with a ball container (3), with a conveying tube (2) which is connected at one end to the latter and the other end of which leads to the weapon (1), and with a conveyor for conveying a continuous row of balls out of the ball container (3) into the conveying tube, wherein the conveying tube (2) is designed as a flexible long conveying hose and the ball container (3) is provided with a carrying fixture (12) independent of the weapon.

13 Claims, 5 Drawing Sheets

DEVICE FOR STORING PROJECTILE BALLS AND FOR FEEDING THEM TO THE PROJECTILE CHAMBER OF A HAND WEAPON

BACKGROUND OF THE INVENTION

In sports weapons with spherical ammunition, so-called paintballs, a magazine container is usually placed onto the weapon above the projectile chamber, the individual balls being fed out of the magazine container to the projectile chamber as a result of the effect of gravity, by means of compressed air or by mechanical conveying means (U.S. Pat. Nos. 5,816,232, 5,282,454, 5,794,606, DE-U-83 14 931, U.S. Pat. Nos. 5,097,816, 5,511,333, 5,736,720, WO98/13660, U.S. Pat. Nos. 5,063,905, 3,788,298, 5,505,188, DE-C-37 21 527, U.S. Pat. Nos. 5,771,875, 1,403,719, 1,743,576, 3,695,246, 5,282,454, 1,404,689). In these, the size of the magazine is disadvantageously restricted, because the weapon has to remain easily maneuverable. The object on which the invention is based is to provide a magazine loading device which overcomes this disadvantage. Launching appliances for play balls (U.S. Pat. Nos. 3,844,267, 4,207,857, 3,248,008, 3,610,223, 3,867,921, 4,027,646) have a stationary design and therefore cannot give any suggestion as to how the moveability of a sports weapon, despite being equipped with a large magazine, can be improved.

SUMMARY OF THE INVENTION

Accordingly, a ball container forming the magazine is provided, independently of the weapon, and is equipped with a carrying fixture which makes it possible to carry said ball container, for example, on the belt, on the back or in any other desired place. The balls are transported from the ball container to the weapon by means of a long flexible conveying hose which does not obstruct the maneuverability of the weapon.

For conveying the balls from the ball container to the weapon, known techniques may be adopted, for example compressed-air conveyance, if the container is equipped with a compression-air accumulator or the conveyor hose is connected to a compressed-air line which leads compressed gas from the weapon to the magazine. In general, however, it is more expedient to use a mechanical conveyor which obtains its drive energy from an energy accumulator, for example an electric battery, which is independent of the weapon and is arranged near the magazine. This avoids the need, between the weapon and the magazine, for additional connections which make the arrangement complicated and susceptible to faults and also make it more difficult for the magazine and conveying arrangement to be adaptable to different weapon systems.

In order to make a high rate of fire possible, it is necessary to ensure that the projectile chamber of the weapon is filled with a new ball again immediately after a shot has been fired. If this is to be carried out solely by the conveyor remote from the weapon, the conveyor motor must have a very high power rating. It is therefore more expedient, according to the invention, to have an arrangement in which the conveyor is designed to maintain a conveying force which is exerted constantly on the row of balls and which is transmitted via a spring means, the spring excursion of which is at least as great as the diameter of a ball. This ensures that, when the projectile chamber is being emptied and opened, the next ball is pressed into the projectile chamber immediately as a result of the effect of the spring force, without this operation being directly dependent on the power output of the conveyor motor. The spring means may be selected to have a spring excursion such that, in the case of a rapid rate of fire, the projectile chamber can be refilled several times in succession solely by means of the spring effect.

For this purpose, a special spring may be provided in the conveying means. Instead, it is also possible for the elasticity of the hose and/or of the row of balls between the conveyor and the weapon to be utilized in order to form the spring means. The overall spring effect may also be composed of the individual effects of a spring provided in the conveying means, of the hose and of the row of balls.

In order to keep the size of the energy accumulator serving for driving the conveyor motor small, it is expedient to switch off the motor during firing intermissions. This is known (U.S. Pat. No. 5,816,232). In the known arrangement, the row of balls is fed by a positive-drive conveyor to a fall zone, the lower end of which opens out in the projectile chamber of the weapon. As soon as the fall zone is filled, the motor is switched off. When a sensor detects that a gap has occurred in the fall zone due to the consumption of balls, the motor is switched on again, in order to fill this gap by the reconveyance of balls. The need for a sensor provided in the fall zone makes the arrangement more complicated. Moreover, on the assumption that, according to the invention, the magazine is arranged remotely from the weapon, the sensor signal would have to be supplied to the conveying system remote from the weapon. The abovementioned spring effect for refeeding balls into the projectile chamber makes it possible to dispense with this complicated arrangement, in that the switching off and on of the motor is made dependent on the state of the spring force. If the spring force (or the spring travel as a measure of the spring force) falls below a predetermined threshold because balls have been consumed, the motor is switched on again. The latter runs until a predetermined threshold of the spring force or of the spring travel is exceeded.

The measuring means necessary for this purpose are very simple. If a special spring is used in conjunction with the conveying means, it can easily be detected, by the means of two limit switches, when the deflection of the spring exceeds or falls short of a specific value. Likewise, it can easily be detected, by means of pressure sensors, when the spring exceeds or falls short of a specific force threshold. If a spring is not provided, the force threshold can easily be measured on the element which exerts the conveying force on the row of balls. If this is the rotor described further below, it is possible, for example, to evaluate the torque of the rotor shaft. Finally, there is the possibility of using the current consumption of the motor as a signal for the conveying force generated by it. Electronic circuits, which may be used for evaluating the signals mentioned and for switching the motor on and off, are generally known and therefore do not need to be described. So that the spring force does not decrease due to the drive mechanism running in reverse after the motor has been switched off, said drive mechanism is expediently designed to be self-locking. This is normally the case when a gearing is provided between the motor and the member which transmits the conveying force to the row of balls.

Although the ball container of the device according to the invention can have virtually any desired size, it may be desirable, for practical reasons, to have size variability. This may be brought about not only by keeping containers of different size ready, but also by connecting a further or a plurality of further ball containers to an existing container or conveyor or conveying hose. For example, a first ball container may be provided with an inlet orifice, to which the outlet of a second ball container, likewise provided with a conveyor, is connected, so that the second ball container fills up the first, as required. On the other hand, there may be provision for connecting the plurality of ball containers in parallel, that is to say for having the possibility of feeding balls simultaneously.

According to a further feature of the invention, the ball container and/or the conveyor may be provided with a counting and indicating means, in order to indicate the number of consumed balls and/or balls still remaining. Indication is expediently digital. An indication of the charging state of the battery and/or the remaining playing time may also be provided.

It is known (U.S. Pat. No. 5,816,232) to use, for conveying the balls, a conveying rotor which rotates in a cylindrical housing part and which has, on the circumference, a row of projections which form, in each case with adjacent projections and the wall, conveying spaces for one ball each. The wall contains an outlet orifice, to which a conveying channel is connected. When the rotor rotates, the balls contained in the conveying spaces arrive in succession at the passage and are pressed through the latter into the conveying channel. The emptied conveying spaces are filled up, under the effect of gravity, from the ball supply located above them. The balls are transferred from the conveying spaces into the outlet orifice provided in the wall, in that there is arranged on the bottom of the container a stationary guide wall, with which the balls come into contact below the projections of the rotor. This arrangement is effective only when the balls are prevented from sliding over and beyond the wall. This purpose is served by a housing wall which, however, has the disadvantage that it may happen that a ball not lying correctly in a conveying space is jammed between the free edge of the housing wall and a rotor projection and thereby blocks conveyance.

The invention eliminates this problem, in that the rotor projections turn the associated ball toward driving faces which are inclined relative to the circumferential direction and to the radial direction in such a way that the driven ball is pressed against a bottom face parallel to the rotor plane and against the wall and into an outlet orifice which is contained in the wall and which is connected to the conveying hose. Solely as a result of the interaction of the oblique driving faces with the balls, the latter are held in bearing contact on the bottom and on the wall and are pressed into the outlet orifice as soon as the latter is reached. In order to reduce friction, the driving face may be formed by a freely rotatable roller.

In order to make it easier for the balls to enter the conveying spaces, a surface portion of the projections which is not inclined relative to the radius may be provided above each driving face. The conveying spaces are thereby preceded by receiving cells, into which the balls can fall more easily from the supply and by which they are then guided to the conveying spaces, without being impeded by increased wall friction.

The movement of the balls into the conveying spaces may take place under the effect of gravity if the axial arrangement of the rotor is vertical. If the intention is to be independent of gravity, so that the functioning of the conveyor can be ensured when the ball container is in any position, the ball supply above the rotor is expediently prestressed toward the rotor by means of a spring force. Insofar as the above explanation stated that the preceding cells are arranged above the conveying spaces or that the ball supply is located above the rotor, this relates to the vertical arrangement, with the rotor provided at the bottom. If the intention is to ensure that the conveyor functions even in a position which is not vertical or is vertically reversed, a spring may be provided, which prestresses the ball supply toward the rotor via a spring plate.

BRIEF DESCRIPTION OF THE DRAWINGS

The invention is explained in more detail with reference to the drawing which illustrates an advantageous exemplary embodiment and in which.

DESCRIPTION OF THE PREFERRED EMBODIMENT

Figure 1:
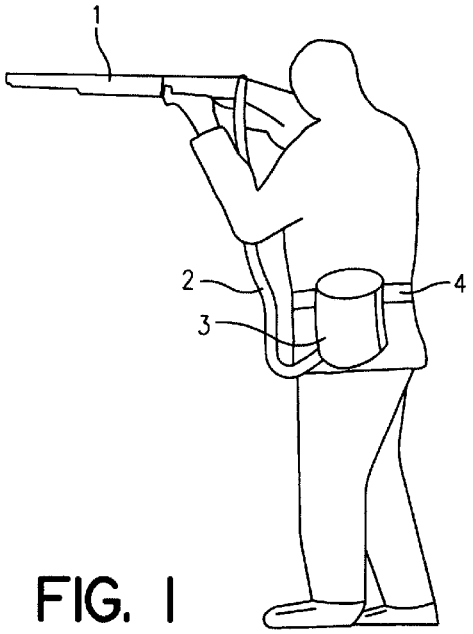
FIG. 1 shows the device according to the invention during use.

According to FIG. 1, a shooter uses a weapon 1, for example an air gun for so-called paintballs, which is connected, via a flexible conveying hose 2, to the ball container 3 containing the ammunition balls. These are conveyed in a continuous row, via the conveyor described later, through the conveying hose 2 to the projectile chamber of the gun 1. At the same time, they are under a spring force, so that, whenever a ball is fired and the empty projectile chamber opens, a new ball is pressed out of the conveying hose 2 or out of the weapon channel, followed by the outlet end of the conveying hose 2, into the projectile chamber. The ball container 3 is fastened to the shooter's belt 4.

Figure 2:
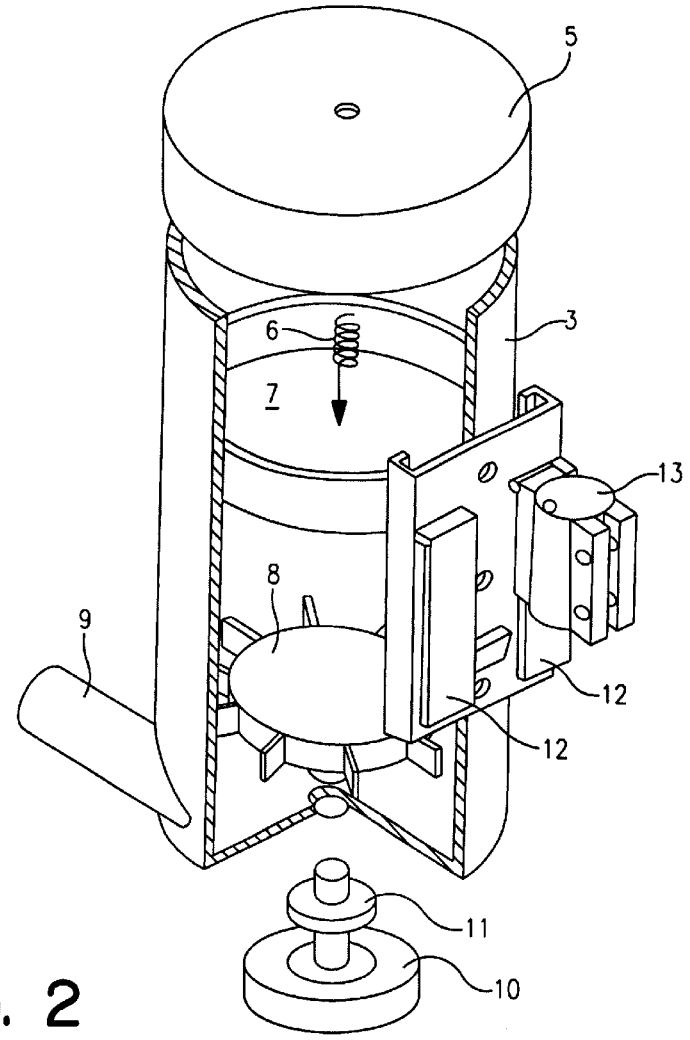
FIG. 2 is an exploded view of the ball container and the conveyor, partially in section and partly in schematic.

According to FIG. 2, the ball container 3 is designed cylindrically and is provided with a closing cover 5 which is connected via a diagrammatically indicated compression spring 6 to a pressure plate 7. The latter, under the effect of the spring 6, presses the container content away from the open container end, closed by the cover 5, toward the other end of said container. Located at this other end is the conveyor 8 which is indicated merely diagrammatically in FIG. 2 and which conveys the balls into the outlet channel 9 of the ball container 3, said outlet channel being connected to the inlet end of the conveying hose 2. The conveyor 8 is driven by an electric motor 10 via a coupling 11 to be described later. The motor 10 is driven by a battery, not illustrated, which is provided at a suitable point in the container 3. The container can be hung on the shooter's belt 4 by means of hooks 12. Moreover, a coupling means 13 may be provided for the selective attachment of the container to the weapon.

The spring plate 7 ensures that the balls contained in the container are fed to the conveyor 8 in any position of the container 3.

Figure 3:
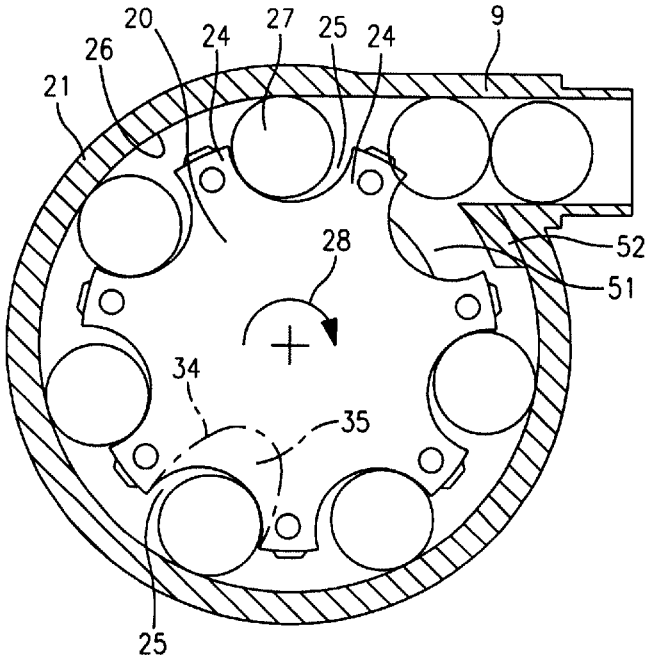
FIG. 3 shows a cross section through the ball container, with the viewing direction toward the conveyor.
Figure 4:
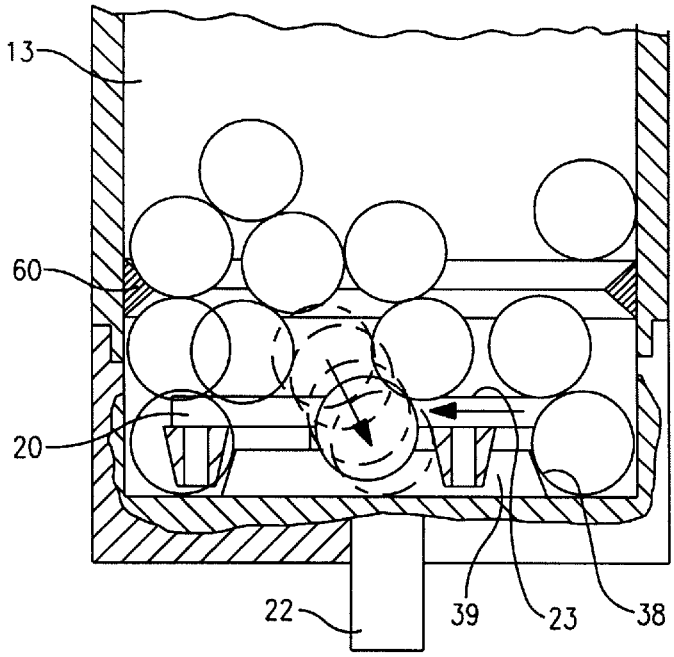
FIG. 4 shows a part longitudinal section through the ball container together with the conveyor.

According to FIGS. 3 and 4, the conveyor 8 is formed by a disk 20 which is arranged concentrically in a cylindrical part 21 of the container 3 on a shaft 22 and which is driven in rotation in the direction of the arrow 28 by means of the motor 10. The disk 20 turns a plane or curved surface 23 toward the container space 13. The disk 20 carries, on its circumference, a ring of projections 24 and recesses 25 which are located between these and which form with the inner face 26 receiving cells for balls 27 which are larger than the balls. Under the effect of gravity or of the spring plate 7, the balls 27 therefore pass easily into these cells and are received by them.

Figure 8:
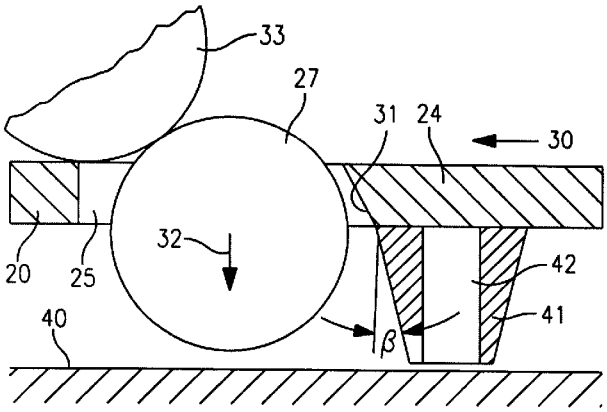
FIGS. 8 and 9 show part longitudinal sections through the conveyor on a larger scale.

As shown in FIG. 8, the edge 31 of the receiving cells 25 which is located at the rear in the direction of rotation 30 may be beveled in such a way that said edge urges the ball 27 falling into a receiving cell further downward in the direction of the arrow 32. This is also assisted by the relative movement in relation to the stationary balls which are located above it and one of which is indicated at 33.

The function of the receiving cells 25 is purely to receive the balls easily and feed them to the conveying members explained later. It has no conveying function itself. Its size may be freely dimensioned solely from the standpoint that the balls easily find their way into the receiving cells and are easily transferred downward by them. So that those balls which are not located in the outer region of the container, but further inward radially, can also be caught, the receiving cells may be widened inward, as indicated by dashes and dots in FIG. 3 at 34, the region 35 between the dashed and dotted line 34 and the edge of the receiving cell 25 being capable of being designed to descend obliquely relative to the receiving cell, in such a way that the balls are guided into the desired radially outer position, in which they can be picked up by the conveying members. Instead of the oblique face 35 on the disk 20, there may also be provision for prolonging the open cross section of the receiving cells 25 radially inward along the line 34 and for providing a corresponding oblique face on a base 39 below the disk 20. Oblique faces on the base 39 and on the disk 20 may also be provided so as to complement one another.

When a ball is caught by a receiving cell 25 and is guided downward in the direction of the arrow 32 (FIG. 8), it finally passes onto the bottom 40 which runs parallel to the disk 20 or perpendicularly to the shaft 22. In this position, the ball comes into contact with a roller 41 which is mounted freely rotatably on a bearing journal 42 fastened to the disk 20 perpendicularly to the latter. Each projection 24 of the disk is provided with such a bearing journal 42 and with a roller 41. The lower face of the disk 20 is so high above the bottom 40 and the rollers 41 are arranged so near the edge 31 of the receiving cells 25 that the balls are picked up reliably by the rollers 41 and do not remain in contact with the fixed edge 31 of the receiving cells 25.

Figure 10:
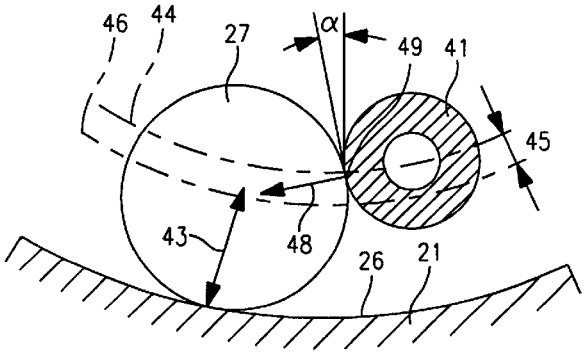
FIG. 10 shows a part cross section through the conveyor on a larger scale.

The axes of rotation of the rollers 41 are somewhat further away from the inner face 26 of the wall 21 than corresponds to the radius 43 of the balls. The radius of their circle of rotation 44 is therefore smaller by the amount 45 than the radius of the circle of rotation 46 of the center points of the balls 27 when these bear both on the bottom 40 and on the inner face 26 of the wall 21 (FIG. 10). The tangent to the (theoretically punctiform) face of contact 49 of the roller 41 with the radius therefore forms an accurate angle alpha. The direction of the conveying force 48 exerted by the roller 41 on the associated ball 27 does not run in the circumferential direction, but has an outwardly directed component, by means of which the ball 27 is held in bearing contact on the inner face 26 of the wall 21.

Figure 9:
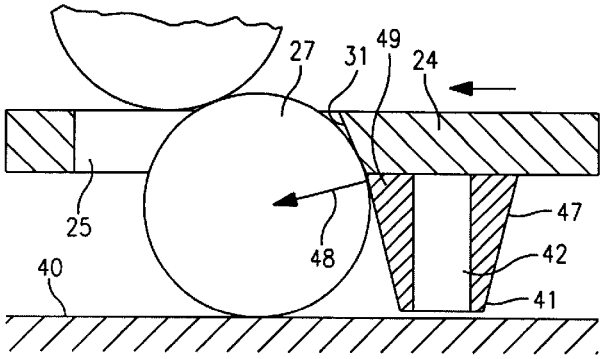

A further obliquity of the face of contact 49 ensures that the balls 27, when they are in the conveying position (FIGS. 9 and 10), are always held in contact with the bottom 40. Specifically, the surface 47 of the roller 41 is designed conically, so that the face of contact 49 does not run vertically, but, in the section according to FIG. 9, is inclined a little downward and rearward at the angle beta. Consequently, the conveying force 48 exerted on the ball 27 contains a component which is directed downward towards the bottom 40 and by means of which the ball is pressed against the bottom.

The conveying position of the balls is thereby determined in the simplest, most reliable and most accurate way, specifically, on the one hand, by the bottom face 40 and the circumferential face 26 and, on the other hand, by the roller 41. This applies, irrespective of any tolerances in the position of the roller 41, insofar as the geometric conditions mentioned above are satisfied. The conveying device according to the invention therefore works very reliably and with a low level of faults.

The face of contact 49 does not necessarily have to be formed by a roller 41; instead, it may also be arranged fixedly on the disk 20. However, the design as a roller surface has the advantage that friction is reduced. Specifically, the balls 27 pressed against the bottom 40 and wall face 26 tend to roll on these faces. If the face of contact 47 is formed by a roller surface, it can participate in this movement, without impeding it. At the same time, it is particularly advantageous if the roller 41 is arranged in such a way that its axis of rotation runs parallel to that of the associated ball 27, that is to say at about 45° to the bottom face 40; however, an appreciable reduction in friction is also achieved even when the roller axis 42 is positioned differently from this ideal direction for the sake of simpler production.

In order to ensure that the balls passing out of the receiving cells into the conveying position travel sufficiently far radially outward, the base 39 may be provided with a corresponding circumferential face 38, of which the distance from the inner face 26 of the wall 21 is such that the balls 27 do not touch the face 38 when they are in the conveying position.

The outlet channel 9 follows the wall 21 tangentially, in such a way that the center axis 50 of said outlet channel forms a tangent to the center point path 46 of the balls. Moreover, the outlet channel 9 follows the bottom 40 continuously.

Figure 5:
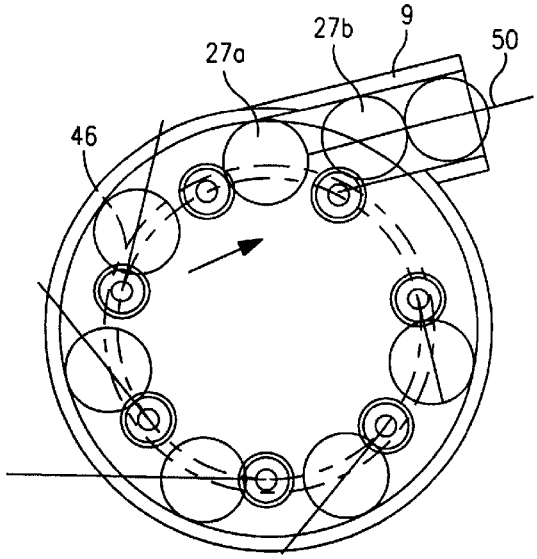
FIGS. 5 to 7 show cross sections through the ball container in the region of the conveyor at different operating stages.
Figure 6:
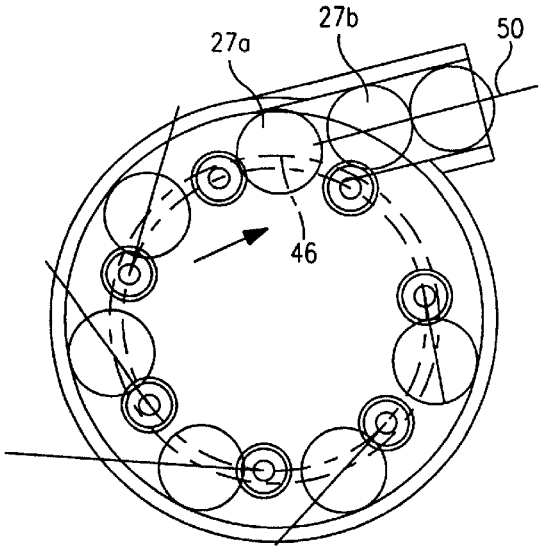
Figure 7:
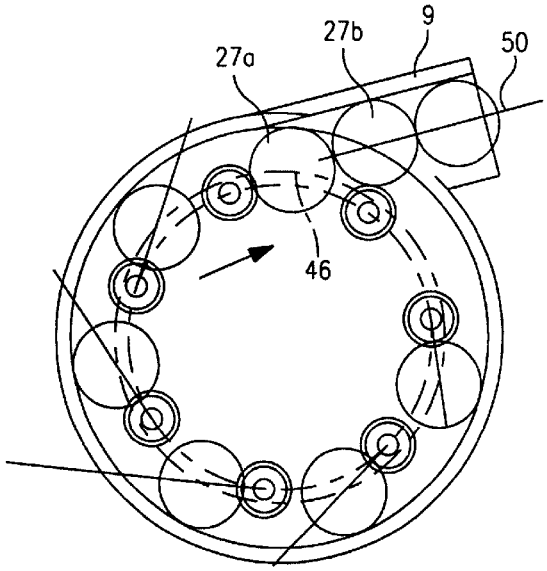

The components of the conveying force 48 which were explained above with reference to FIGS. 9 and 10 and which are directed toward the wall face 26 and the bottom 40 ensure that the balls 27 approaching the outlet channel come into exact alignment with the latter (more precisely: with the line of which the distance from the outer and lower wall of the outlet duct is equal to the ball radius) and, finally, are pushed into said outlet channel. The latter occurrence becomes clear from a consideration of the position sequence illustrated in FIGS. 5 to 7. In FIG. 5, the ball 27*a* has reached, on its center point path 46, the center line 50 of the outlet channel 9. In the course of its movement (FIGS. 6 and 7), it no longer follows the center point path 46, but, instead, the center line 50. At the same time, the angle alpha, explained with reference to FIG. 10, increases constantly, as does, consequently, the radially outward-directed force component exerted on the ball by the associated conveying roller. With all the greater reliability, the ball is held on the path which guides it into the outlet channel. This can be seen clearly from a consideration of the relative position of the balls 27*b* in FIGS. 5 and 6. Due to the geometric conditions, the conveying speed of the ball 27*b* decreases in this path segment. Consequently, the distance of said ball from the ball 27*a* following it decreases it, until said distance disappears at the stage of FIG. 7 and a continuous row of balls conveyed through the outlet channel 9 and into the conveying hose 2 is obtained.

The height of the surface 23 of the disk 20 above the bottom 40 is not appreciably smaller or is even a little greater than the diameter of the balls 27, in order to reduce the resistance which the stationary balls exert on the balls moved through under them and located in the conveying position.

Provided on the container wall, a generous ball diameter above the surface 23 of the disk 20, is an annually continuous collar 60 which forms a brake for the balls pressing forward from above and which, above all, relieves those balls which are located above the disk 20 adjacently to the container wall and above the row of balls located in the conveyor. This, too, is a means of reducing the resistance exerted on the moved balls by the stationary balls.

So that the receiving cell 51 (FIG. 3) just emptied in to the conveying channel 9 is not refilled prematurely, which under specific conditions could lead to complications, this is prevented by the provision of a filler piece 52 which is fixed to the housing. Only when the cell 51 has passed the filler piece 52 completely can it be refilled. The filler piece 52 has no function in guiding the balls 27 into the outlet channel 9. This is because they are held in bearing contact on the radially outer face of the conveying channel by the outwardly directed component of the conveying force 48 and therefore cannot touch the filler piece 52.

As mentioned above, in order to achieve as high a rate of fire as possible, it is necessary that the ball appearing directly at the breech of the projectile chamber of the weapon be under the conveying force and be moved into the projectile chamber immediately after the latter is opened. This conveying force and conveying movement may be furnished directly by the conveyor described and its drive, if the row of balls and the conveying hose are imagined as being inelastic. For this purpose, however, the motor would have to be of very high power in order to overcome the inertia forces and be switched on constantly, even when a conveying movement is not taking place. This is highly energy-consuming. There is therefore provision for switching off the motor as soon as conveyance is not necessary, and a spring means is provided which maintains the conveying force and generates the conveying movement. In a simplest case, this spring means is formed by the conveying hose and/or the row of balls. Under the conveying force, the hose is deflected elastically and generates a return force corresponding to the conveying force. The balls located in the conveying row are correspondingly pressed together elastically by the conveying force. When the sum of the elastic elongation of the hose and the elastic compression of the row of balls is greater than at least one ball diameter, they can cause the ball which appears to be transferred into the projectile chamber as a result of elastic contraction or expansion, even when the motor is not switched on. The same also applies to a plurality of balls in succession, if the elongation of the hose or the compression of the row of balls is correspondingly high.

As a result there is sufficient conveying force available even for a relatively large burst of fire, the motor must start up immediately, as required. This is carried out by measuring the torque occurring on the shaft 22 of the conveyor, said torque being proportional to the conveying force prevailing in the row of balls. According to the invention, the coupling 11 may be designed for measuring this torque and signal the fact that the torque has fallen short of a predetermined torque threshold to the electronics which control the motor and which thereupon switch the motor on. Conversely, they switch the motor off when the coupling 11 communicates the fact that a predetermined torque threshold has been exceeded.

Figure 11:
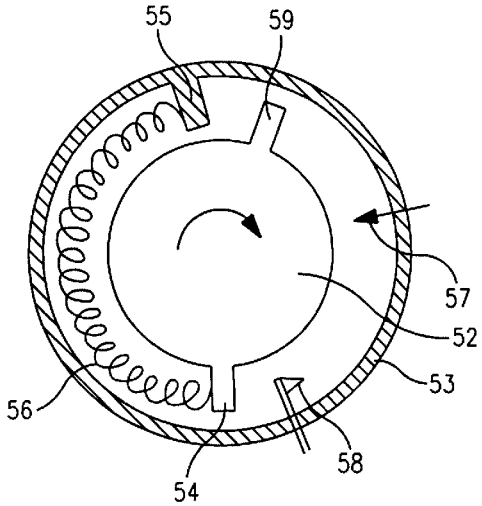
FIG. 11 shows a diagrammatic illustration of a rotary coupling with a spring means and with sensing of the spring excursion.

If the elasticity of the hose and of the row of balls is not sufficient for forming the spring reserve, a special spring means is provided in the construction, which may be arranged, for example, in the coupling 11 and, diagrammatically, is designed as shown in FIG. 11. The inner coupling part 52 is driven in the direction of the arrow by the motor 10. The outer coupling part 53 mounted concentrically thereto is connected to the shaft 22 of the conveyor. The two coupling parts 52, 53 have stops 54, 55 which are located opposite one another in the circumferential direction and between which a compression spring 56 acts. The latter is compressed as a result of the rotation of the driving coupling part 52 and by the resistance of the row of balls. One of the coupling parts (the outer coupling part in the case illustrated) is provided with contacts or limit switches 57, 58 and the other coupling part is provided with a boss 59 which co-operates with these. When a particular length of the spring 56 is exceeded and, consequently, when the torque acting between the coupling parts falls short of a threshold value, the contact 57 is closed. Its signal causes the motor to be started up. The spring 57 is thereby compressed, and the boss 59 moves away from the contact 57, whilst approaching the contact 58. As soon as a limit torque is reached, which corresponds to the desired conveying force, the contact 58 is activated and causes the motor to be switched off. When, as a result of a burst of fire, conveyance takes place, as a result of which the energy of the spring 56 is consumed and the latter is elongated, the motor is switched on when the conveying force threshold defined by the position of the contact 57 is reached. If a starting delay is to be expected in the motor, the contact 57 is positioned in such a way that the spring 56 still makes a sufficient force reserve available, even below this threshold.

Figure 12:
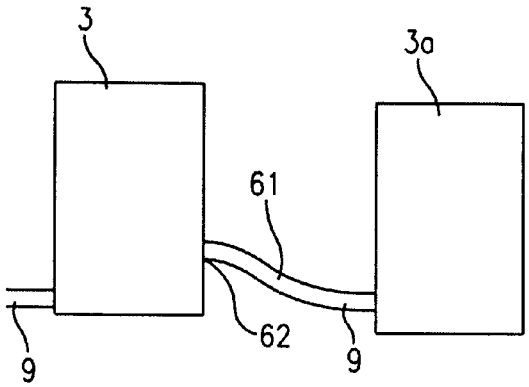
FIGS. 12 and 13 show coupled arrangements of two ball containers.

FIG. 12 shows the possibility of combining another ball container 3*a* with a primary ball container 3. The conveyor of the other ball container 3*a* conveys the balls located in it, via a hose 61, into a receiving orifice 62 provided on the ball container 3.

Figure 13:
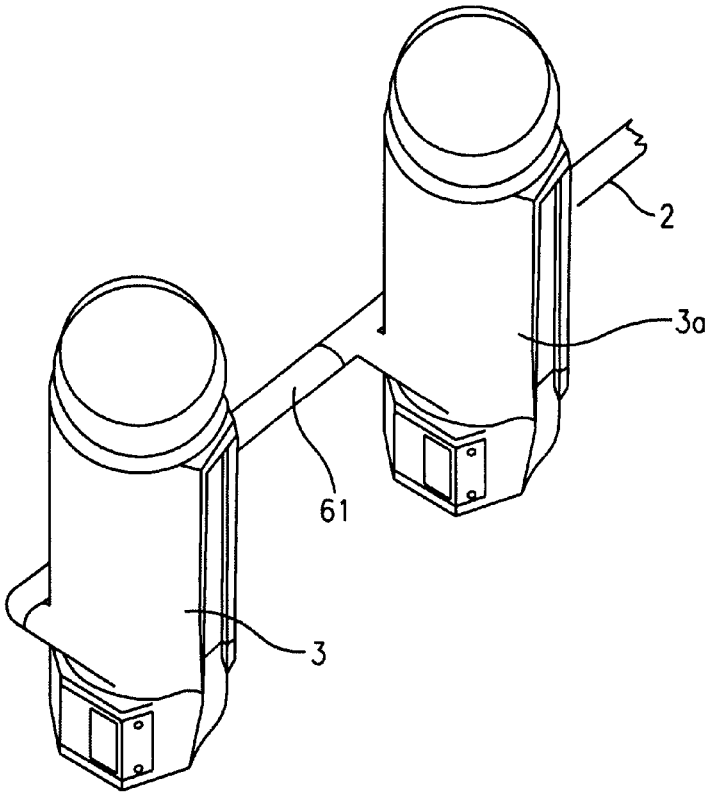

In the embodiment of FIG. 13, the two ball containers 3, 3*a* are connected in parallel and convey the balls into the conveying hose 2 directly or via a hose 61.

What is claimed is:

1. A device for storing projectile balls and for feeding them to the projectile chamber of a hand weapon comprising a ball container with a conveying tube which is connected at one end to the ball container and the other end of which is readable to the weapon and with a conveyor for conveying a continuous row of balls out of the ball container into the conveying tube, wherein the conveyor maintains a conveying force which is exerted constantly on the row of balls and which conveying force is transmitted by a spring means, the conveying tube comprises a flexible conveying hose that is elastic in a longitudinal direction and the spring means is formed at least partially from elastic deformation of the conveying hose under the conveying force exerted on the row of balls by the conveyor and the ball container is independent of the weapon and is provided with a carrying fixture for carrying the ball container independent of the weapon.

2. The device as claimed in claim 1, wherein said spring means has a spring excursion and the spring excursion of said spring means is at least as great as the diameter of a ball.

3. The device as claimed in claim 2, wherein the spring means is formed at least partially by a spring provided on the conveyor.

4. The device as claimed in claim 1, and further comprising a projectile weapon having a breech, wherein the row of balls leads constantly, without any gap, from the conveyor to the breech of the weapon.

5. The device as claimed in claim 1, wherein the conveyor is equipped with an independent energy supply.

6. The device as claimed in claim 1, wherein the conveyor is provided with a conveying motor and a means for switching the conveying motor on and off when the conveying force or the spring excursion falls short of or exceeds a specific value.

7. The device as claimed in claim 1, further comprising at least one additional ball container, wherein the ball container or the conveyor or the conveying hose is provided with a connecting orifice for the connection of the outlet of the at least one additional ball container.

8. The device as claimed in claim 1, further comprising a plurality of ball containers, wherein said plurality of ball containers are connected in parallel.

9. The device as claimed in claim 2, wherein the balls elastically deform under compression and the spring means is formed at least partially from elastic deformation of the row of balls under the conveying force exerted on the row of balls by the conveyor.

10. The device as claimed in claim 2, wherein the conveyor includes a spring, the balls elastically deform under compression and the spring means is formed from energy stored in an elastically deformed conveying tube, and elastically deformed row of balls and a compressed conveyor spring.

11. A device for storing projectile balls and for feeding them to the projectile chamber of a hand weapon, said device comprising:

at least one ball container provided with a carrying fixture permitting the ball container to be carried independent of the weapon;

a flexible conveying hose which is connected at one end to the ball container and the other end of which is leadable to the weapon; and a conveyor for conveying a continuous row of balls out of the ball container into the conveying hose, wherein the conveyor comprises:

a generally planar bottom face;

a generally circular wall having an inner surface and an outlet orifice connected to said conveying hose; and a rotor arranged parallel with said bottom face and concentric with said wall and having a direction of rotation about an axis of rotation, said rotor having a circumference and a plurality of radial projections from the circumference which define ball spaces bounded by said projections and said wall inner surface, each said projection having a driving face projecting from the bottom side of said rotor, each said driving face being radially and axially inclined so that a ball received in a said ball space is pressed axially against said bottom face and radially outwardly against said inside surface during rotation of said rotor.

12. The device as claimed in claim 11, wherein the driving face is formed by a freely rotatable roller.

13. The device as claimed in claim 11, wherein a receiving cell, the width of which is considerably greater than the extent of a ball, is provided above that part of the conveyor which forms the driving face.

* * * * *

UNITED STATES PATENT AND TRADEMARK OFFICE

CERTIFICATE OF CORRECTION

PATENT NO. : 6,327,953 B1
DATED : December 11, 2001
INVENTOR(S) : Andresen

It is certified that error appears in the above-identified patent and that said Letters Patent is hereby corrected as shown below:

Column 8,
Line 60, change "readable" to -- leadable --.

Signed and Sealed this

Ninth Day of July, 2002

*Attest:*

*Attesting Officer*

JAMES E. ROGAN
*Director of the United States Patent and Trademark Office*